US008888445B2

(12) United States Patent
Pruthi et al.

(10) Patent No.: US 8,888,445 B2
(45) Date of Patent: Nov. 18, 2014

(54) TURBOMACHINE SEAL ASSEMBLY

(75) Inventors: Rohit Pruthi, Karnataka (IN); Sanjay Shankar Jadhav, Karnataka (IN)

(73) Assignee: General Electric Company, Schenectady, NY (US)

( * ) Notice: Subject to any disclaimer, the term of this patent is extended or adjusted under 35 U.S.C. 154(b) by 699 days.

(21) Appl. No.: 13/213,238

(22) Filed: Aug. 19, 2011

(65) Prior Publication Data

US 2013/0045090 A1 Feb. 21, 2013

(51) Int. Cl.
*F01D 11/00* (2006.01)

(52) U.S. Cl.
CPC ..... *F01D 11/005* (2013.01)
USPC ..... 415/174.1

(58) Field of Classification Search
USPC ..... 415/173.7, 174.1, 174.3, 174.5; 277/500, 508, 307, 438
See application file for complete search history.

(56) References Cited

U.S. PATENT DOCUMENTS

| | | | |
|---|---|---|---|
| 110,549 | A | 12/1870 | Cheek |
| 227,148 | A | 5/1880 | Clark |
| 654,257 | A | 7/1900 | Hunter |
| 875,721 | A | 1/1908 | Mertes |
| 1,609,952 | A | 12/1926 | Ledwinka |
| 3,759,038 | A | 9/1973 | Scalzo et al. |
| 3,965,066 | A | 6/1976 | Sterman et al. |
| 4,645,217 | A | 2/1987 | Honeycutt, Jr. et al. |
| 4,785,623 | A | 11/1988 | Reynolds |
| 5,014,917 | A | 5/1991 | Sirocky et al. |
| 5,125,796 | A | 6/1992 | Cromer |
| 5,127,799 | A | 7/1992 | Berry |
| 5,265,412 | A | 11/1993 | Bagepalli et al. |
| 5,333,992 | A | 8/1994 | Kane et al. |
| 5,398,496 | A | 3/1995 | Taylor et al. |
| 5,400,586 | A | 3/1995 | Bagepalli et al. |
| 5,470,198 | A | 11/1995 | Harrogate et al. |
| 5,630,700 | A | 5/1997 | Olsen et al. |
| 5,657,998 | A | 8/1997 | Dinc et al. |
| 6,059,526 | A * | 5/2000 | Mayr ..... 415/231 |
| 6,547,257 | B2 | 4/2003 | Cromer |
| 6,637,752 | B2 | 10/2003 | Aksit et al. |
| 6,675,584 | B1 | 1/2004 | Hollis et al. |
| 6,860,108 | B2 | 3/2005 | Soechting et al. |
| 6,895,757 | B2 | 5/2005 | Mitchell et al. |
| 7,007,482 | B2 | 3/2006 | Green et al. |
| 7,080,513 | B2 | 7/2006 | Reichert |

(Continued)

FOREIGN PATENT DOCUMENTS

| | | |
|---|---|---|
| EP | 0875721 A1 | 4/1998 |
| EP | 0875721 B1 | 8/2002 |

(Continued)

OTHER PUBLICATIONS

International Search Report and Written Opinion for International Application No. PCT/RU2008/000110; mailed Dec. 4, 2008, pp. 1-15.

(Continued)

*Primary Examiner* — Dwayne J White
(74) *Attorney, Agent, or Firm* — Cantor Colburn LLP

(57) ABSTRACT

A turbomachine seal assembly includes a base member, a rocker arm pivotally mounted to the base member, and a seal element fixedly mounted to the rocker arm. The seal element is configured and disposed to selectively shift relative to the base member.

20 Claims, 3 Drawing Sheets

(56) References Cited

U.S. PATENT DOCUMENTS

| | | | |
|---|---|---|---|
| 7,524,167 | B2 | 4/2009 | Ohri et al. |
| 2006/0038358 | A1 | 2/2006 | James |
| 2006/0127219 | A1 | 6/2006 | Zborovsky |
| 2007/0284828 | A1 | 12/2007 | Komukai et al. |

FOREIGN PATENT DOCUMENTS

| | | | |
|---|---|---|---|
| EP | 1609952 | A1 | 12/2005 |
| EP | 1609952 | B1 | 1/2008 |
| GB | 2037380 | A | 7/1980 |
| JP | 2002339706 | A | 11/2002 |
| JP | 200383088 | A | 3/2003 |
| JP | 2004301115 | A | 10/2004 |
| JP | 2005337122 | A | 12/2005 |
| WO | 0227148 | A1 | 4/2002 |

OTHER PUBLICATIONS

JP Office Action dated Apr. 3, 2012 from JP Application No. 2010-548635 along with unofficial English translation.

International Search Report and Written Opinion for corresponding PCT Application No. PCT/RU2008/000110, dated Apr. 12, 2008, pp. 1-15.

* cited by examiner

TURBOMACHINE SEAL ASSEMBLY

BACKGROUND OF THE INVENTION

The subject matter disclosed herein relates to the art of turbomachines and, more particularly, to a seal assembly that extends between two stationary turbomachine components.

In a typical can-annular gas turbomachine, combustors are arranged in an annular array. The combustors receive a supply of pressurized air from a compressor portion of the turbomachine, and a supply of fuel. The pressurized air and fuel are mixed to form a combustible air/fuel mixture. The air/fuel mixture is ignited to form hot gases that are directed into a turbine portion of the turbomachine. Thermal energy from the hot gases is converted to mechanical, rotational energy in the turbine portion.

The hot gases are passed along a hot gas path that extends between various stationary members of the turbomachine. For example, combustion gases pass from the combustors through a transition piece and toward a first stage of the turbine portion. The transition piece is secured to the turbine portion at an interface region. A seal is positioned in the interface region to prevent any escape of the hot gases. Often times the transition piece and the turbine portion are formed from different materials having distinct thermal rates of expansion. As such, after exposure to the hot gases a gap at the interface region expands. Over time, the seal becomes fatigued and is no longer capable of spanning the gap during all operating conditions.

BRIEF DESCRIPTION OF THE INVENTION

According to one aspect of an exemplary embodiment, a turbomachine seal assembly includes a base member, a rocker arm pivotally mounted to the base member, and a seal element fixedly mounted to the rocker arm. The seal element is configured and disposed to selectively shift relative to the base member.

According to another aspect of the exemplary embodiment, a turbomachine includes a first fixed member having an outlet, a second fixed member having an inlet fluidly connected to the outlet of the first fixed member, and a seal assembly extending between the first fixed member and the second fixed member. The seal assembly includes a base member fixedly mounted to one of the first fixed member and the second fixed member, a rocker arm pivotally mounted to the base member, and a seal element fixedly mounted to the rocker arm. The seal element is configured and disposed to selectively shift relative to the base member as the first fixed member shifts relative to the second fixed member.

According to yet another aspect of the exemplary embodiment, a turbomachine includes a turbine portion having a turbine casing defining a turbine inlet, a transition piece operatively connected to the turbine portion. The transition piece includes a transition piece outlet coupled to the turbine casing at the turbine inlet. A seal assembly extends between the transition piece outlet and the turbine inlet. The seal assembly includes a base member fixedly mounted to one of the transition piece and the turbine portion, a rocker arm pivotally mounted to the base member, and a seal element fixedly mounted to the rocker arm. The seal element is configured and disposed to selectively shift relative to the base member as the transition piece shifts relative to the turbine portion.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
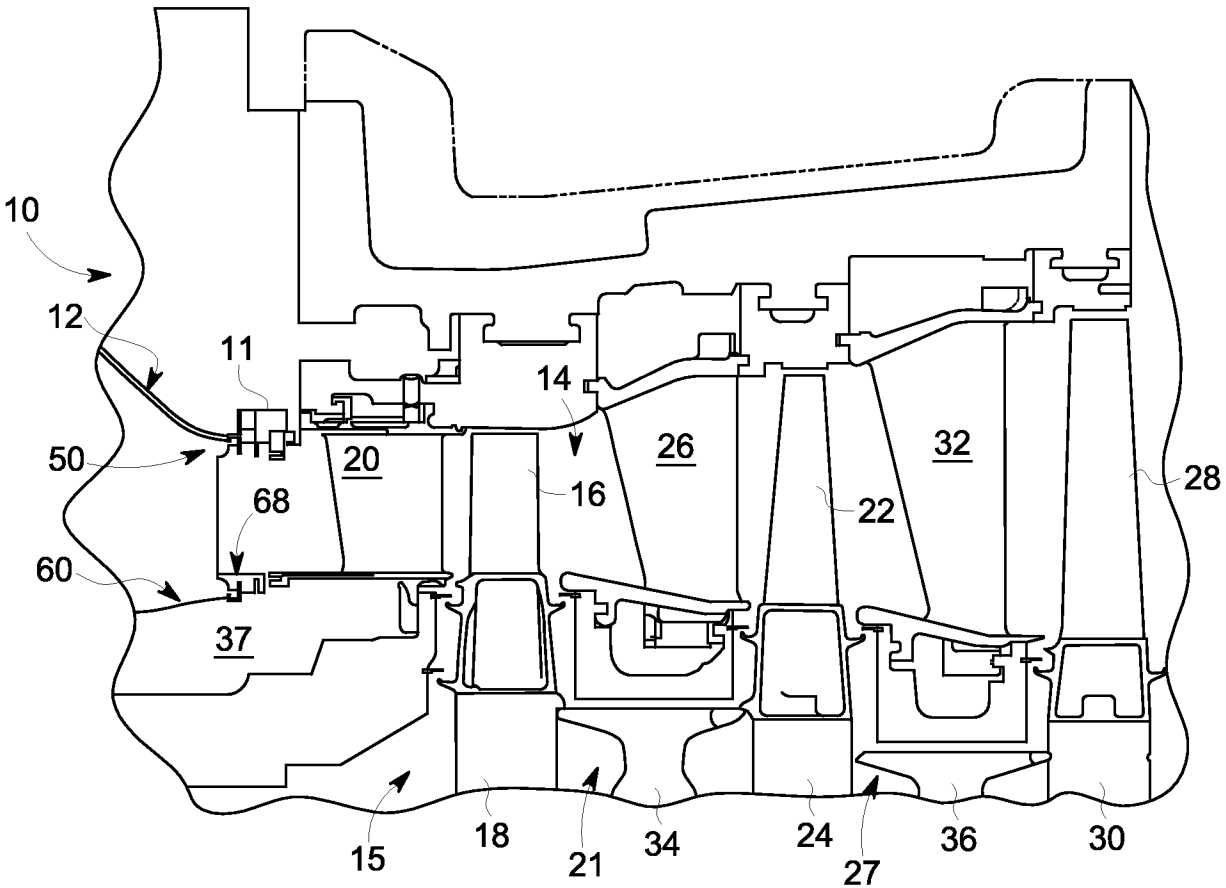
FIG. 1 is a partial schematic side elevational view of a transition piece coupled to a turbine portion of a turbomachine, and a seal assembly in accordance with an exemplary embodiment arranged between the transition piece and turbine portion.

With initial reference to FIG. 1, there is illustrated a representative example of a turbine portion of a gas turbine, generally indicated at 10. Turbine portion 10 includes a fixed member or turbine casing 11 that is operatively connected to an annular array of combustors (not shown) through another fixed member or transition duct or piece 12. Transition piece 12 transmits hot gases of combustion from the annular array of combustors to an annular hot gas path 14. The hot combustion gases flow along hot gas path 14 and through a plurality of turbine stages as will be detailed below. The turbine stages convert thermal energy from the hot gases into mechanical, rotational energy that is used to power various mechanical devices such as generators, pumps and the like.

The hot gases pass initially toward a first stage 15 having a plurality of circumferentially spaced buckets 16 mounted on a first-stage roller or welder wheel 18 and a plurality of circumferentially spaced stator vanes 20. The hot gases pass to a second stage 21 having a plurality of buckets 22 mounted on a roller or welder wheel 24 and a plurality circumferentially spaced stator vanes 26 and on to a third stage 27. Third stage 27 includes a plurality of circumferentially spaced buckets 28 mounted on a third stage roller or welder wheel 30 and a plurality of circumferentially spaced stator vanes 32. Of course, it will be appreciated that the number of stages present within turbine portion 10 can vary. It will also be appreciated that stator vanes 20, 26, and 32 are mounted on, and fix to, turbine casing 11, while buckets 16, 22, and 28, and wheels 18, 24 and 30 form part of the turbine welder. Turbine portion 10 is also shown to include a plurality of spacers 34 and 36 arranged between welder wheels 18, 24 and 30. Finally, it should be appreciated that compressor discharge air enters turbine portion 10 at a region 37 disposed radially inward of first stage 15. As such, air within region 37 is at a higher pressure than the hot gases following along hot gas path 14. At this point it should be understood that the above described structure is provided for the sake of completeness and to aide in better understanding the exemplary embodiment which is directed to a seal assembly 50 arranged between transition piece 12 and turbine casing 11.

Figure 2:
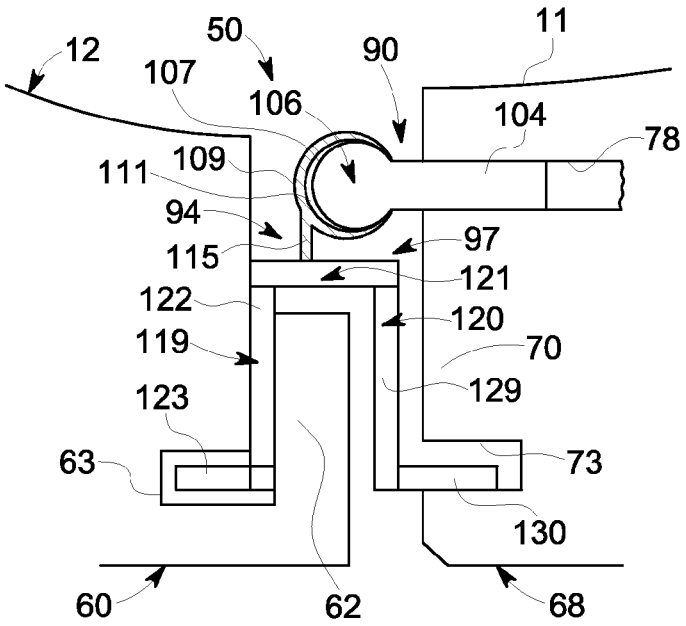
FIG. 2 is a detail view of the seal assembly positioned between the transition piece and the turbine portion of FIG. 1.

As best shown in FIG. 2, transition piece 12 includes a transition piece outlet 60 defined by an outlet flange 62. Outlet flange 62 includes a first seal receiving portion 63 which, as will be discussed more fully below, is configured to receive a portion of seal assembly 50. Similarly, turbine portion 10 includes a turbine inlet 68 defined by an inlet flange 70 having a second seal receiving portion 73 configured to receive another portion of seal assembly 50. Inlet flange 70 is also shown to include a seal mounting member 78 that is configured to support seal assembly 50.

Figure 3:
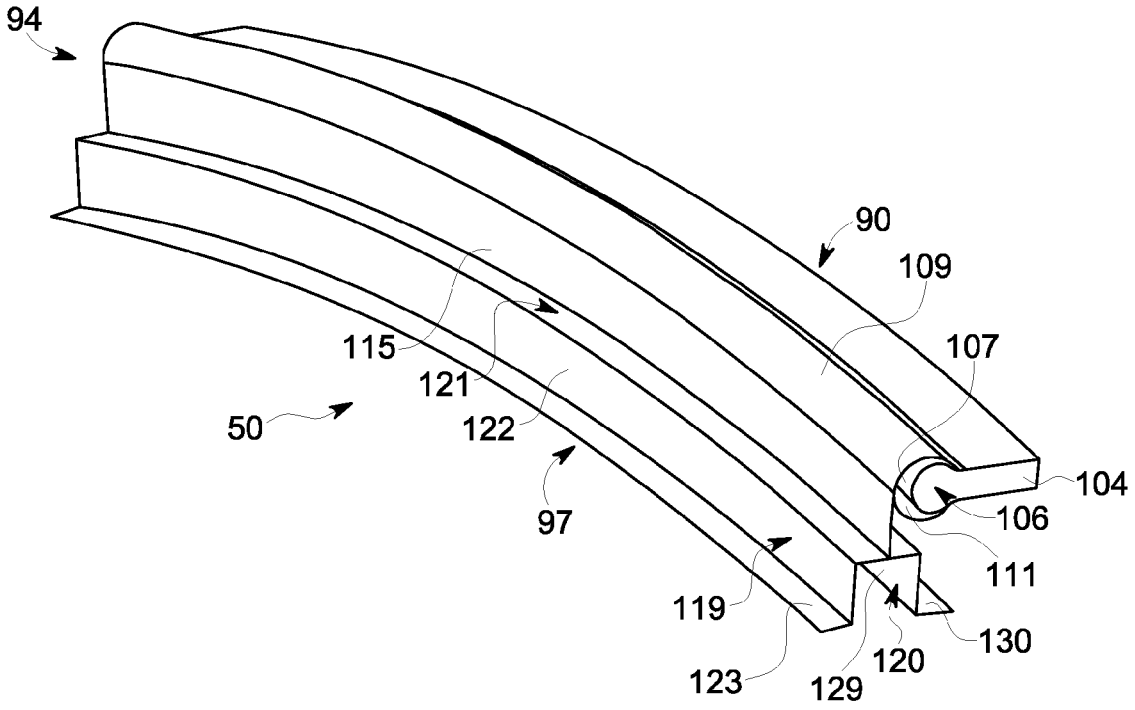
FIG. 3 is a perspective view of the seal assembly of FIG. 2.

In accordance with one aspect of the exemplary embodiment illustrated in FIG. 3, seal assembly 50 includes a base member 90, a rocker arm 94, and a seal element 97. Base member 90 includes a base portion 104 that is mounted to inlet flange 70 in seal mounting member 78. Base portion 104 extends to a pivoting member 106 having a substantially circular outer surface 107. Pivoting member 106 is pivotally connected to a pivoting element 109 of seal assembly 50. Pivoting element 109 includes a substantially circular groove element 111 that is configured to receive pivoting member 106. Pivoting element 109 is coupled to seal element 97 through a cantilevered mounting element 115. As shown, seal element 97 includes a first seal portion 119 that is coupled to a second seal portion 120 through a connecting member 121. First seal portion 119 includes a first seal section 122 and a second seal section 123. Second seal section 123 extends into first seal receiving portion 63 while first seal portion 122 seals against outlet flange 62. Similarly, second seal portion 120 includes a first seal section 129 and a second seal section 130. Second seal section 130 extends into second seal receiving portion 73 while first seal section 129 seals against inlet flange 70. With this arrangement, seal element 97 shifts or pivots relative to base member 90 to remain in contact with outlet flange 62 and inlet flange 70 despite any dimensional changes in transition piece 12 and/or turbine casing 11 resulting from thermal expansions and contractions.

Figure 4:
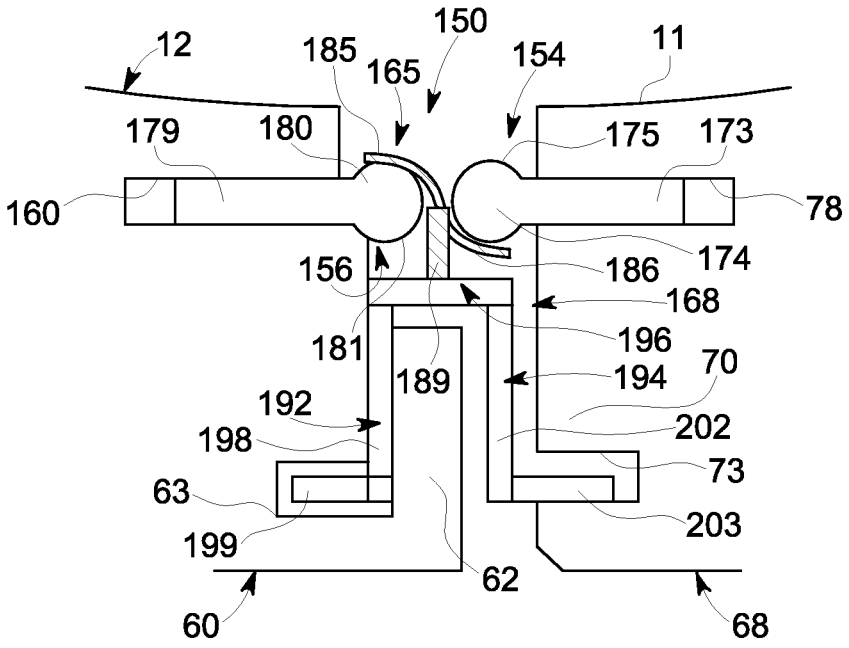
FIG. 4 is a detail view of a seal assembly in accordance with another aspect of the exemplary embodiment positioned between the transition piece and the turbine portion of FIG. 1.
Figure 5:
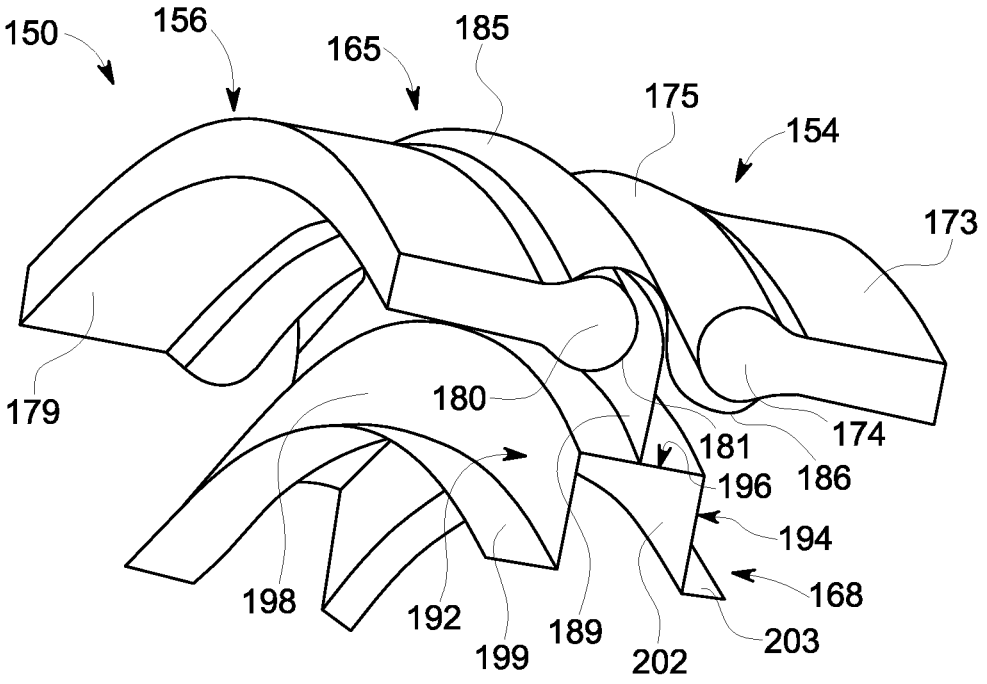
FIG. 5 is a perspective view of the seal assembly of FIG. 4.

Reference will now be made to FIGS. 4 and 5 in describing a seal assembly 150 in accordance with another aspect of the exemplary embodiment. Seal assembly 150 includes a first base member 154 and a second base member 156. First base member 150 is mounted to inlet flange 70 in seal mounting member 78 while second base member 156 is mounted to outlet flange 62 in another seal mounting member 160. First and second base members 154 and 156 are operatively coupled to a rocker arm 165 and a seal element 168.

First base member 154 includes a base portion 173 that is mounted to inlet flange 70. Base portion 173 extends to a first pivoting member 174 having a substantially circular outer surface 175. Similarly, base member 156 includes a base portion 179 that is mounted to outlet flange 62. Base portion 179 extends to a second pivoting member 180 having a substantially circular outer surface 181. Rocker arm 165 includes a first pivoting element 185 that pivots over second pivoting member 180 and a second pivoting element 186 that pivots or travels over first pivoting member 174. First and second pivoting elements 185 and 186 are connected to a cantilevered mounting element 189 that links rocker arm 165 with seal element 168. In a manner similar to that described above, seal element 168 includes a first seal portion 192 coupled to a second seal portion 194 through a connecting member 196. First seal portion 192 includes first and second seal elements 198 and 199. Second seal element 199 extends into first seal receiving portion 63 while first seal element 198 seals against outlet flange 62. Second seal portion 194 includes first and second seal elements 202 and 203. Second seal element 203 extends into second seal receiving portion 73 while first seal element 202 seals against inlet flange 72. With this arrangement, rocker arm 165 pivots back and fourth over first and second pivoting members 174 and 180 to adjust for any relative movement of transition piece 12 relative to turbine casing 11.

At this point it should be understood that the exemplary embodiments describe a seal assembly that pivots about a pivoting member to ensure that a seal element remains in contact with mating surfaces despite dimensional changes of adjacent members. That is, thermal expansions and contractions can open an interface region between to mating surfaces. The seal assembly in accordance with the exemplary embodiments pivots as one, another, or both of the mating surface undergo dimensional changes. It should also be understood that while described as sealing an interface between a transition piece and a turbine portion of a turbomachine, the seal assembly in accordance with the various aspects of the exemplary embodiment can be used to seal between mating surfaces of other components that undergo dimensional changes.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbomachine seal assembly comprising:

a base member, a rocker arm pivotally mounted to the base member, and a seal element fixedly mounted to the rocker arm, the seal element being configured and disposed to selectively shift relative to the base member.

2. The turbomachine seal assembly according to claim 1, wherein the seal element includes a first seal portion configured and disposed to adjoin a first fixed member and a second seal portion configured and disposed to adjoin a second fixed member.

3. The turbomachine seal assembly according to claim 1, wherein the base member includes a pivoting member, the rocker arm being mounted to the pivoting member.

4. The turbomachine seal assembly according to claim 3, wherein the rocker arm includes a pivoting element operatively engaged with the pivoting member.

5. The turbomachine seal assembly according to claim 4, wherein the pivoting member includes a substantially circular outer surface and the pivoting element includes a substantially circular groove element, the substantially circular outer surface of the pivoting member being pivotally received by the substantially circular groove element of the pivoting element.

6. The turbomachine seal assembly according to claim 4, wherein the rocker arm includes a cantilevered mounting element that extends between the pivoting element and the seal element.

7. The turbomachine seal assembly according to claim 1, further comprising: another base member configured and disposed to be mounted opposite the base member, the rocker arm being pivotally mounted to each of the base member and the another base member.

8. The turbomachine seal assembly according to claim 7, wherein the base member includes a first pivoting member and the another base member includes a second pivoting member.

9. The turbomachine seal assembly according to claim 8, wherein the rocker arm includes a first pivoting element operatively coupled to the first pivoting member of the base member and a second pivoting element operatively coupled to the second pivoting member of the another base member.

10. A turbomachine comprising:

a first fixed member having an outlet;

a second fixed member having an inlet fluidly connected to the outlet of the first fixed member; and a seal assembly extending between the first fixed member and the second fixed member, the seal assembly including a base member fixedly mounted to one of the first fixed member and the second fixed member, a rocker arm pivotally mounted to the base member, and a seal element fixedly mounted to the rocker arm, the seal element being configured and disposed to selectively shift relative to the base member as the first fixed member shifts relative to the second fixed member.

11. The turbomachine according to claim 10, wherein the first fixed member includes a first seal receiving portion and the second fixed member includes a second seal receiving portion, the seal element including a first seal portion that extends into the first seal receiving portion and a second seal portion that extends into the second seal receiving portion.

12. The turbomachine according to claim 10, wherein the base member includes a pivoting member, the rocker arm being mounted to the pivoting member.

13. The turbomachine according to claim 12, wherein the rocker arm includes a pivoting element operatively engaged with the pivoting member.

14. The turbomachine according to claim 13, wherein the pivoting member includes a substantially circular outer surface and the pivoting element includes a substantially circular groove element, the substantially circular outer surface of the pivoting member being pivotally received by the substantially circular groove element of the pivoting element.

15. The turbomachine according to claim 13, wherein the rocker arm includes a cantilevered mounting element that extends between the pivoting element and the seal element.

16. The turbomachine according to claim 10, further comprising: another base fixedly mounted to the other of the first fixed member and the second fixed member, the rocker arm being pivotally mounted to each of the base member and the another base member.

17. The turbomachine according to claim 16, wherein the base member includes a first pivoting member and the another base member includes a second pivoting member.

18. The turbomachine according to claim 17, wherein the rocker arm includes a first pivoting element operatively coupled to the first pivoting member of the base member and a second pivoting element operatively coupled to the second pivoting member of the another base member.

19. A turbomachine comprising:

a turbine portion having a turbine casing defining a turbine inlet;

a transition piece operatively connected to the turbine portion, the transition piece including a transition piece outlet coupled to the turbine casing at the turbine inlet; and a seal assembly extending between the transition piece outlet and the turbine inlet, the seal assembly including a base member fixedly mounted to one of the transition piece and the turbine portion, a rocker arm pivotally mounted to the base member, and a seal element fixedly mounted to the rocker arm, the seal element being configured and disposed to selectively shift relative to the base member as the transition piece shifts relative to the turbine portion.

20. The turbomachine according to claim 19, wherein the transition piece outlet includes a first seal receiving portion and the turbine inlet includes a second seal receiving portion, the seal element including a first seal portion that extends into the first seal receiving portion and a second seal portion that extends into the second seal receiving portion.

* * * * *